US006131495A

United States Patent [19]

Chen

[11] Patent Number: 6,131,495

[45] Date of Patent: Oct. 17, 2000

[54] TOOL HAVING REPLACEABLE TOOL HEADS

[76] Inventor: Jin-Fu Chen, P.O. Box 2103, Taichung, Taiwan

[21] Appl. No.: 09/333,020

[22] Filed: Jun. 15, 1999

[51] Int. Cl.[7] ..... B25B 7/02

[52] U.S. Cl. ..... 81/423; 81/416; 81/417

[58] Field of Search ..... 81/415, 416, 417, 81/418, 421, 422, 423, 385, 405, 407, 427.5, 342, 381, 383; 294/118, 119

[56] References Cited

U.S. PATENT DOCUMENTS

| | | | |
|---|---|---|---|
| 839,993 | 1/1907 | Fritz | 81/422 |
| 1,505,510 | 8/1924 | Uhl | 81/423 |
| 2,507,710 | 5/1950 | Grosso | 81/342 |
| 3,742,957 | 7/1973 | White | 81/342 |
| 5,752,419 | 5/1998 | Liou | 81/416 |

*Primary Examiner*—David A. Scherbel
*Assistant Examiner*—Joni B. Danganan
*Attorney, Agent, or Firm*—Rosenberg, Klein & Lee

[57] ABSTRACT

A tool includes two grips and at least one tool head. The grips can be opened to different extents so as to rotate the fixing pins of the grips relative to the openings of the tool head. Accordingly, the short sides of the fixing pins can be respectively aligned with the openings to permit the detachment of the grips from the tool head. Otherwise, the grips are stopped by the long sides of the fixing, pins from detaching from the tool head. The grips can be easily and quickly assembled with or disassembled from the tool head. In addition, the replacement of the tool head can be performed by hand without using any tool or switch. Also, the tool has fewer components which are not easy to miss.

3 Claims, 7 Drawing Sheets

TOOL HAVING REPLACEABLE TOOL HEADS

BACKGROUND OF THE INVENTION

The present invention relates to a tool in which the grips can be opened by a larger angle to facilitate the replacement of tool heads with different usages.

FIGS. 6 and 7 show a conventional tool composed of two grips 9 and multiple tool heads 91. The front end of each grip 9 is formed with a socket 92. The bottom of the tool head 91 is disposed with two insertion sections 93. The insertion sections 93 are inserted into the sockets 92 of the grips 9 and two bolts 94 are screwed into the grips 9 and the insertion sections 93 of the tool head 91 so as to replaceably connect the tool head 91 with the grips 9.

According to the above arrangement, the tool head 91 must be locked by the bolts 94. When replacing the tool head 91, the bolts 94 must be untightened by a screwdriver 95. Moreover, when tightening the bolts 94, the bolts 94 must be aimed at the insertion sections 93 and the grips 9. Therefore, it is uneasy to replace the tool head and the bolts 94 are likely to miss. In another conventional tool, the grips 9 are equipped with a switch for inserting with the tool head 91 (not shown). When replacing the tool head 91, the switch must be switched. Such procedure is troublesome.

SUMMARY OF THE INVENTION

It is therefore a primary object of the present invention to provide a tool including two grips and over one tool head. The grips can be opened to different extents so as to rotate the fixing pins of the grips relative to the openings of the tool head. Accordingly, the short sides of the fixing pins can be respectively aligned with the openings to permit detachment of the grips from the tool head. Otherwise, the grips are stopped by the long sides of the fixing pins from detaching from the tool head. The grips can be easily and quickly assembled with or disassembled from the tool head. In addition, the replacement of the tool head can be performed by hand without using any tool or switch. Also, the tool has fewer components that are not easy to miss.

It is a further object of the present invention to provide the above tool having double lever structure which can be operated with strength saved.

The present invention can be best understood through the following, description and accompanying drawings wherein:

DETAILED DESCRIPTION OF THE PREFERRED EMBODIMENTS

Figure 1:
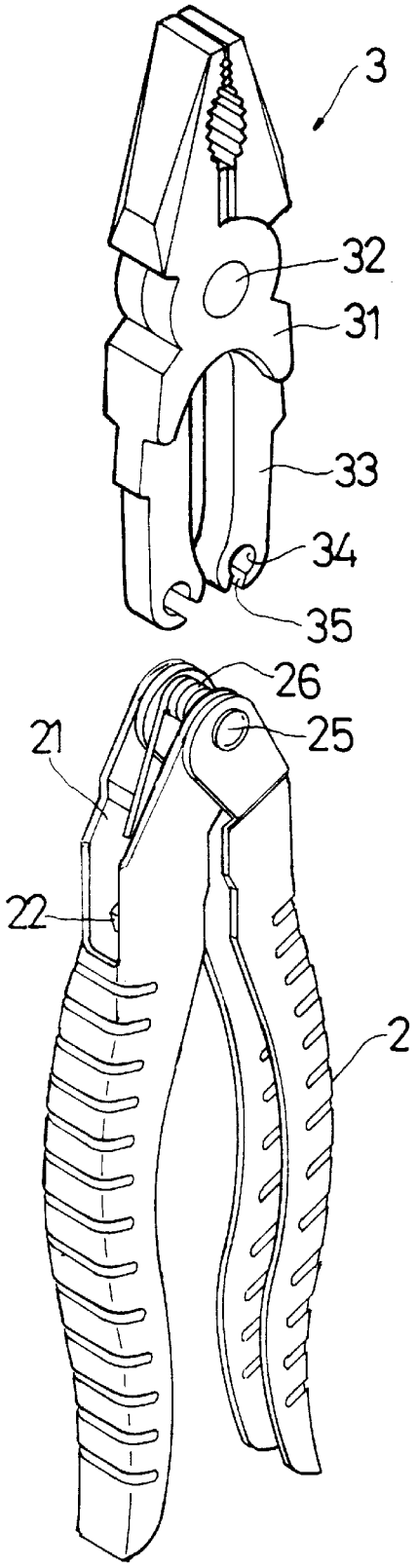
FIG. 1 is a perspective exploded view of the tool of the present invention.

Please refer to FIGS. 1 to 5. The tool of the present invention includes:

two elongated grips 2, a top section of each grip being formed with a socket 21, an inner side of the socket 21 being disposed with a fixing pin 22, the fixing pin 22 having two axial plane faces on two sides and two arcuate faces on two sides extending therebetween, whereby the cross-section of the fixing pin 22 having a long side 23 with a first length 231 and a short side 24 with a second length 241, the first length 231 being equal to the diameter of the fixing pin 22, the second length 241 being a distance between the two plane faces, the first length 231 being longer than the second length 241, the top ends of the grips 2 being pivotally connected by a pivot shaft 25, a resilient member 26 such as a torque spring being disposed on the pivot shaft 25, a tool head 3 which is one of various tools with different usages, such as a pincers, the tool head 3 being composed of two clamping members 31 pivotally connected with each other by a pivot shaft 32 spaced from the grips 2 by a certain distance, the lower side of each clamping member 31 of the tool head 3 being disposed with an insertion section 33, the bottom end of the insertion section 33 being formed with an insertion notch 34 having an opening 35, the width of the opening 35 being less than the width of the insertion notch 34 and the first length 231 of the fixing pin 22 of the grip 22 and larger than the second length 241 of the fixing pin 22.

Figure 4:
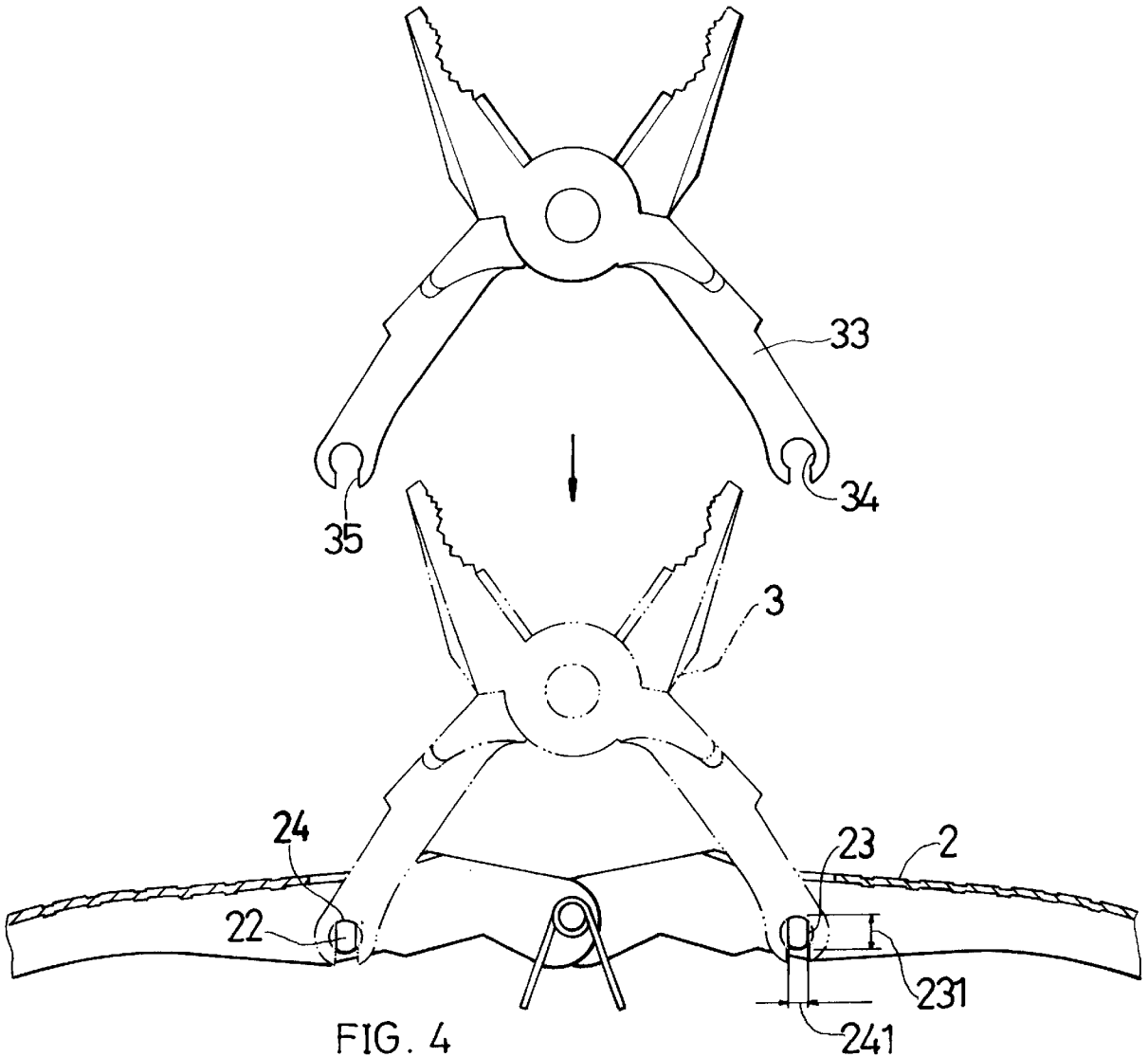
FIG. 4 is a plane view of the tool of the present invention, showing that the grips are opened for taking out the tool head.
Figure 5:
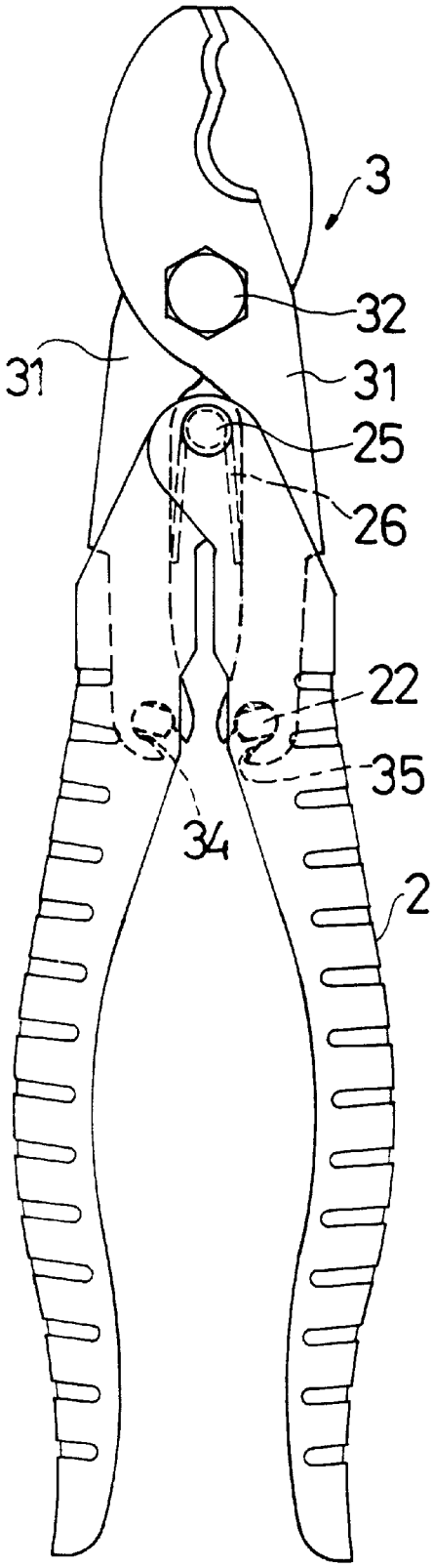
FIG. 5 shows that the tool head can be replaced by a different tool head.
Figure 6:
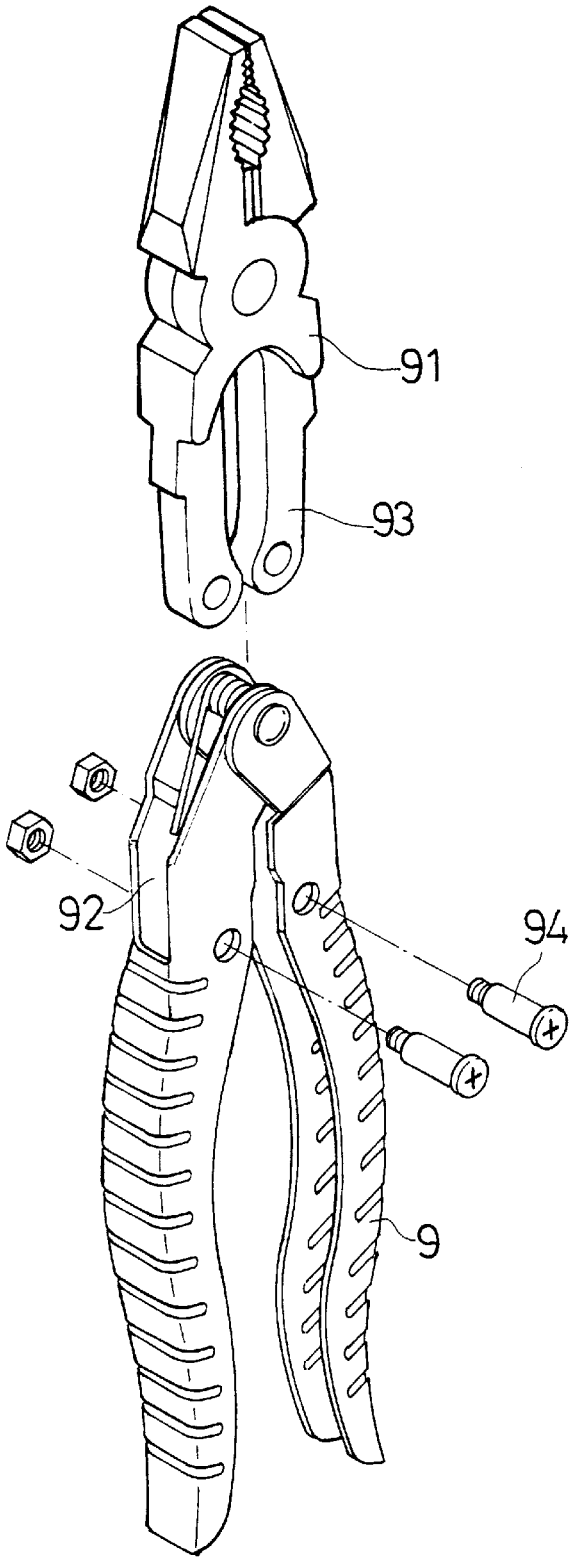
FIG. 6 PRIOR ART
FIG. 6 is a perspective exploded view of a conventional tool.
Figure 7:
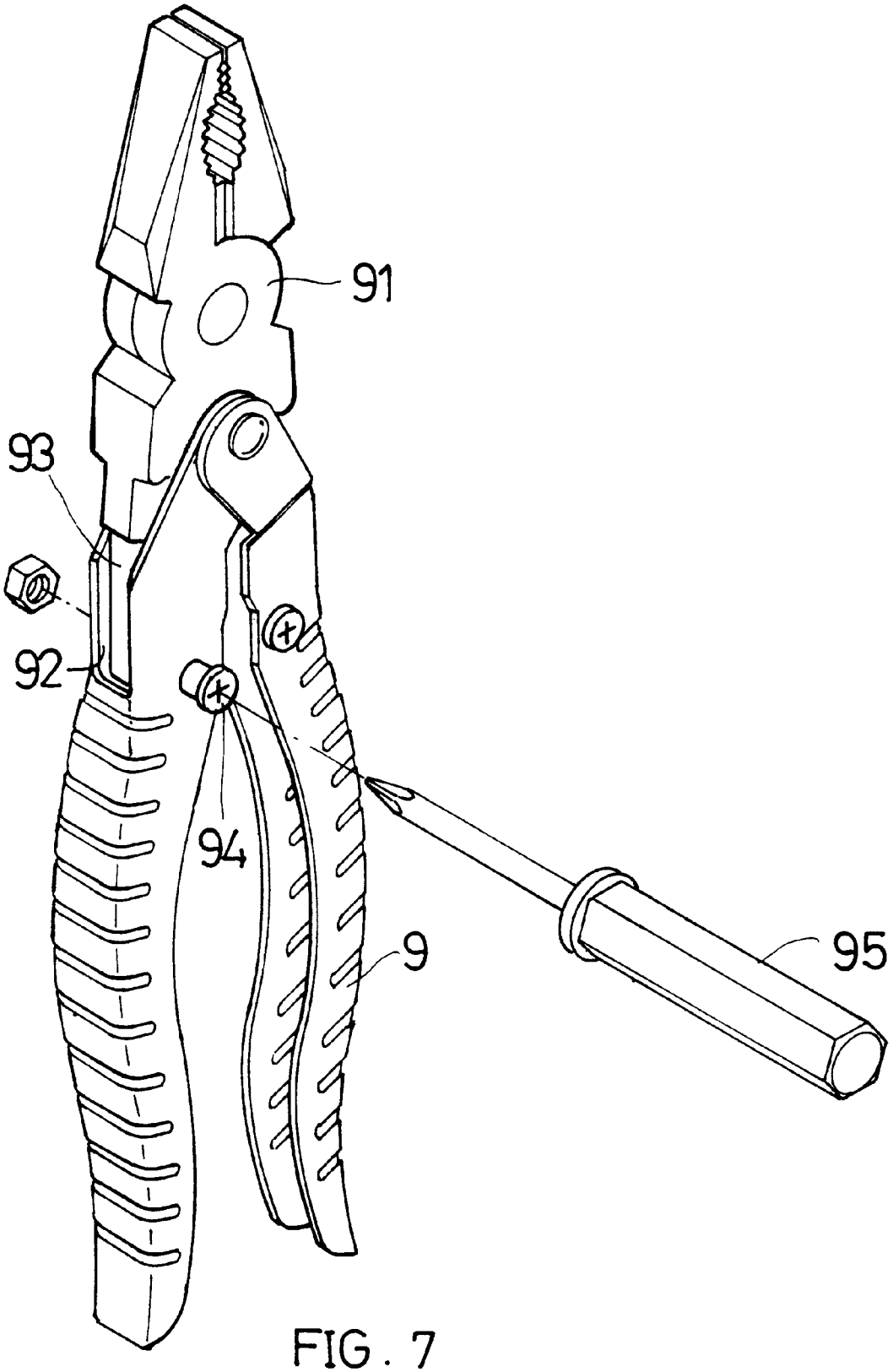
FIG. 7 PRIOR ART
FIG. 7 is a view according to FIG. 6, showing the replacement of the tool head of the conventional tool.

As shown in FIG. 4, when the grips 2 are opened to a certain extent, the short sides 24 of the fixing pins 22 are respectively aimed at the openings 35 of the tool head 3 and the insertion sections 33 of the tool head 3 are inserted into the sockets 21 of the grips 2. Then the fixing pins 22 of the grips 2 are inserted into the insertion notches 34 of the tool head 3. Then the grips 2 are closed toward each other. At this time, due to the distance between the grips 2 and the pivot shaft 25 of the tool head 3, the fixing pins 22 of the grips 2 are rotated relative to the openings 35 of the tool head 3. Therefore, the grips 2 are stopped by the long sides 23 from detaching from the tool head 3 and thus the grips 2 are firmly associated with the tool head 3.

Figure 2:
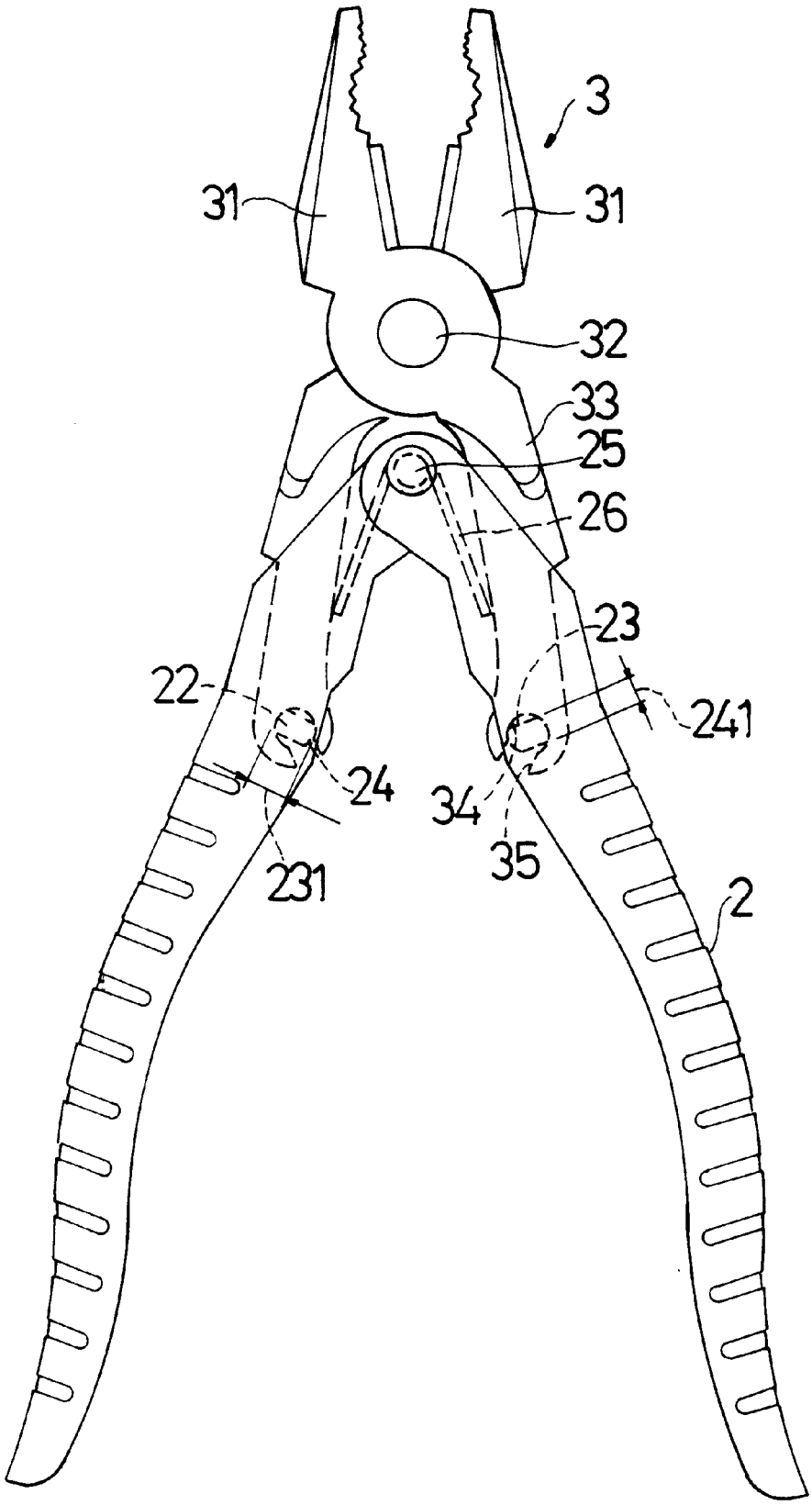
FIG. 2 is a plane view of the tool of the present invention, showing the positions of the grips and the fixing, pins in use.
Figure 3:
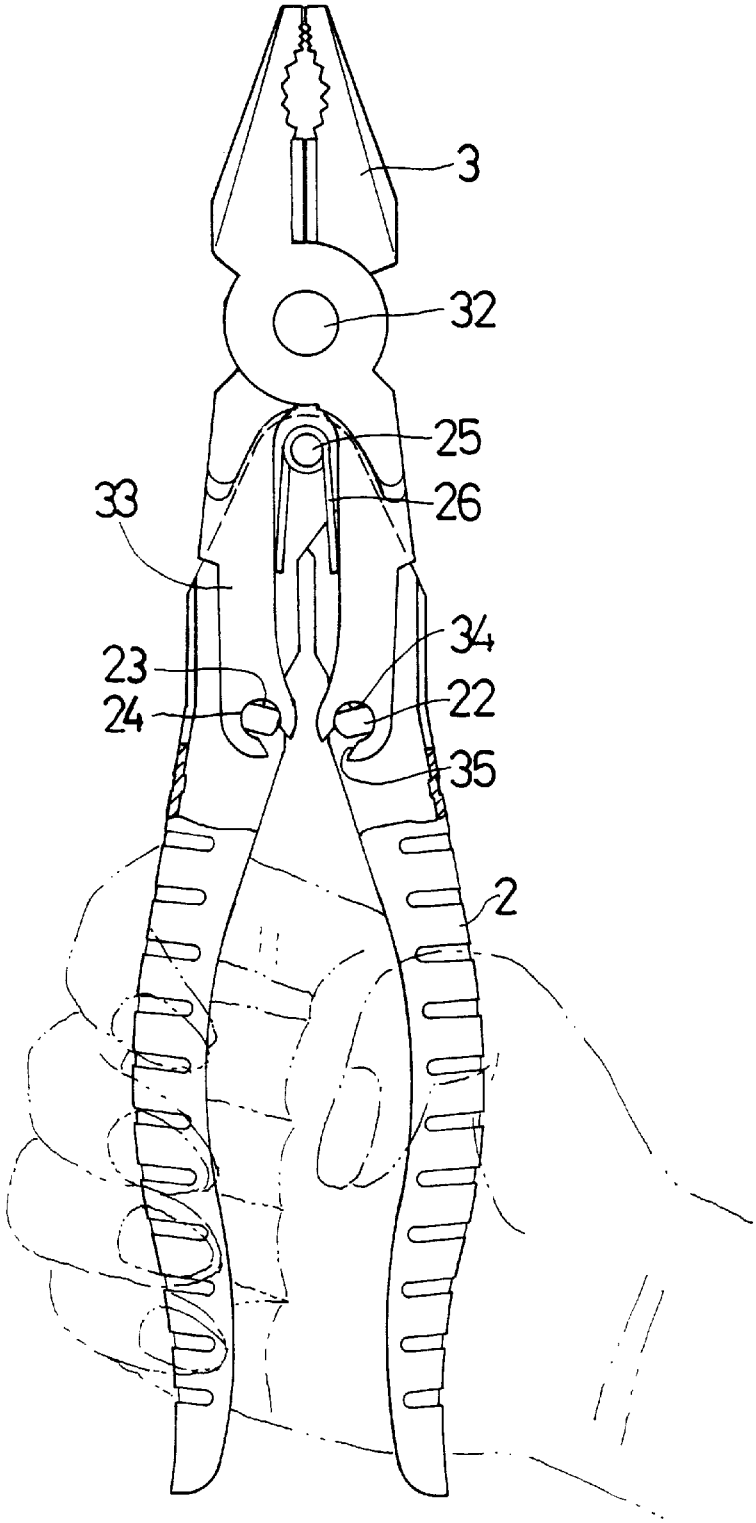
FIG. 3 is a plane view of the tool of the present invention, showing the positions of the grips and the fixing pins in a closed state.

When replacing the tool head 3, the grips 2 are opened with the short sides 24 aligned with the openings 35 of the tool head 3. At this time, the tool head 3 can be easily taken out. In addition, the resilient member 26 of the grips 2 abuts against the two clamping members 31 of the tool head 3 to keep the top ends of the grips 2 open in a normal state. However, as shown in FIG. 2, the grips 2 are not opened to such an extent that the short sides 24 are aligned with the openings 35 of the tool head 3. Therefore, the grips 2 are still firmly associated with the tool head 3 without detachment.

Moreover, by means of the distance between the grips 2 and the pivot shaft 25 of the tool head 3 and by means of the pivotally connected fixing pins 22 of the grips 2 and the insertion notches 34 of the tool head 3, the tool of the present invention has a double lever structure which can be operated with strength saved.

The above embodiment of the present invention can be modified. For example, the fixing pins 22 can be alternatively disposed on the tool head 3 and the insertion notches 34 can be formed on the grips 2.

According to the above arrangement, the grips can be opened to different extents so as to rotate the fixing, pins 22 of the grips 2 relative to the openings 35 of the tool head 3. Accordingly, the short sides 24 are respectively aligned with the openings 35 to permit detachment of the grips 2 from the tool head 3. Otherwise, the grips 2 are stopped by the long sides 23 from detaching from the tool head 3. Therefore, the grips 2 can be easily and quickly assembled with or disassembled from the tool head 3. In addition, the replacement of the tool head can be performed by hand without using any tool or switch. Also, the present invention has fewer components which are not easy to miss.

The above embodiments are only used to illustrate the present invention, not intended to limit the scope thereof. Many modifications of the above embodiments can be made without depart in, from the spirit of the present invention.

What is claimed is:

1. A tool comprising:

(a) a pair of grips coupled one to the other in pivotally displaceable manner about a grip pivot axis, each said grip including a fixing pin extending in a direction parallel to said grip pivot axis, at least a portion of said fixing pin having an oblong sectional contour defined by transversely related long and short dimensions; and, (b) a tool head releasably coupled to said grips, said tool head including a pair of clamping members coupled one to the other in pivotally displaceable manner about a pivot axis offset from and parallel to said grip pivot axis, each of said clamping members having formed at an end portion thereof an insertion notch coaxially engaging said fixing pin of one of said grips in angularly displaceable manner, said insertion notch having an opening defined by a sectional dimension less than said long dimension of said fixing pin but greater than said short dimension of said fixing pin for selective passage of said fixing pin therethrough responsive to the relative angular positions of said coupled grip and clamping member.

2. The tool as recited in claim 1 wherein each said fixing pin is disposed within a socket formed in a top section of said grip.

3. The tool as recited in claim 1 wherein said portion of each said fixing pin having said oblong sectional contour forms an elongate body, said elongate body having a pair of substantially planar axially extended faces on opposing sides thereof.

* * * * *